US007680440B2

(12) United States Patent
Kawashima

(10) Patent No.: US 7,680,440 B2
(45) Date of Patent: Mar. 16, 2010

(54) ROTARY DEVELOPING DEVICE

(75) Inventor: Tetsuro Kawashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 427 days.

(21) Appl. No.: 11/698,125

(22) Filed: Jan. 26, 2007

(65) Prior Publication Data

US 2007/0177901 A1 Aug. 2, 2007

(30) Foreign Application Priority Data

Jan. 30, 2006 (JP) ..... 2006-020579

(51) Int. Cl.
*G03G 15/01* (2006.01)

(52) U.S. Cl. ..... 399/227

(58) Field of Classification Search ..... 399/227, 399/226, 223
See application file for complete search history.

(56) References Cited

U.S. PATENT DOCUMENTS 5,331,390 A * 7/1994 Kimura et al. ..... 399/227
2003/0026627 A1* 2/2003 Kishigami et al. ..... 399/227
2005/0078983 A1* 4/2005 Maruyama et al. ..... 399/227

FOREIGN PATENT DOCUMENTS

JP 11-024361 A 1/1999
JP 2002005244 A * 1/2002

* cited by examiner

*Primary Examiner*—Susan S Lee
(74) *Attorney, Agent, or Firm*—Global IP Counselors, LLP

(57) ABSTRACT

A rotary developing device 30 is provided in an image forming device that is rotated by an input gear 46. The rotary developing device 30 has a plurality of developing units 13, a frame 28, and a rotation stop mechanism 50. Each of the plurality of developing units 13 house toner of one of the colors, and develops at a predetermined developing position. The frame 28 includes a support portion 36 that supports the plurality of developing units 13 and has a rotation shaft, and a ring shaped gear 29 that is rotated by the input gear 46. The rotation stop mechanism 50 stops the rotation of the frame 28 at the developing position. Also, the number of gear teeth in the ring shaped gear 29 is the number of gear teeth in the input gear 46 multiplied by the number of developers.

22 Claims, 7 Drawing Sheets

ROTARY DEVELOPING DEVICE

CROSS-REFERENCE TO RELATED APPLICATIONS

This application claims priority to Japanese Patent Application No. 2006-020579 filed on Jan. 30, 2006. The entire disclosure of Japanese Patent Application No. 2006-020579 is hereby incorporated herein by reference.

BACKGROUND OF THE INVENTION

1. Field of the Invention

The present invention generally relates to a rotary developing device. More specifically, the present invention relates to a rotary developing device provided in an image forming device that is rotated by an input gear member to which motive force is input from a drive source.

2. Background Information

Image forming devices for forming color images include a plurality of developing units each containing a different color developer. There are image forming devices that, for size reduction, include a rotary developing device in which a plurality of developers is installed on a rotatable frame (see Japanese Patent Application Laid-open No. H 1-24361).

In this image forming device that includes a rotary developing device, when forming a color image, the frame that supports the developing units that house the developer of each color is rotated to bring a developing unit to the developing position, and images in the respective colors are formed. In this way, a single full color image is formed.

When developing with the rotary developing device, it is necessary to position a developing unit at the developing position where developing can be carried out. If the position of the developing unit deviates from the developing position the image quality is reduced. Therefore, it is necessary to position the developing units at the developing position with high accuracy.

In the rotary developing device disclosed in Japanese Patent Application Laid-open No. H11-24361, a control is necessary to stop each developing unit at the predetermined developing position. Therefore, a complex control is used to position the developing units at the developing position.

In view of the above, it will be apparent to those skilled in the art from this disclosure that there exists a need for an improved rotary developing device. This invention addresses this need in the art as well as other needs, which will become apparent to those skilled in the art from this disclosure.

SUMMARY OF THE INVENTION

It is an object of the present invention to position accurately developing units containing a developer for each respective color at the developing position, with a simple structure.

A rotary developing device according to a first aspect of the present invention is provided in an image forming device that is rotated by an input gear member to which motive force is input from a drive source. The rotary developing device has a plurality of containers, a support member, and a rotation stop mechanism. Each of the plurality of containers houses a developer of one of the colors, and develops at a predetermined developing position. The support member includes a support portion that supports the plurality of containers and has a rotation shaft, and a ring shaped gear that is rotated by the input gear member. The rotation stop mechanism stops the rotation of the support member at the developing position.

Also, the number of gear teeth in the ring shaped gear is the number of gear teeth in the input gear member multiplied by the number of containers.

In this rotary developing device, when the support member is rotated by the input gear member and one of the containers is positioned at the developing position, the rotation of the support member is stopped by the rotation stop mechanism. When a container is positioned at the developing position, an image in the first color is developed. Thereafter, the support member rotates together with the input gear member, and the container containing the developer of the second color is moved to the developing position. At this time, by rotating the input gear member exactly one revolution from the state in which the container for the first color is in the developing position, the container for the second color is positioned at the developing position. When the container is positioned at the developing position the rotation of the support member is stopped by the rotation stop mechanism, and developing of the second color is carried out. In this way, images in each color are formed in turn, and ultimately a single full color image is formed.

Here, the rotary developing device is positioned at the developing position for each revolution of the input gear member. Therefore the rotation stop mechanism stops the rotation for each revolution of the input gear member. Therefore with a simple mechanism it is possible to position accurately the developing units that contain the developer in their respective color at the developing position.

A rotary developing device according to a second aspect of the present invention is the rotary developing device according to the first aspect, wherein the rotation stop mechanism has a first latching member fitted to the input gear member, a second latching member capable of latching with the first latching member, and a second latching member drive mechanism connected to the second latching member that drives the second latching member so that the second latching member and the first latching member are latched or unlatched.

In this rotary developing device, the first latching member is rotated together with the input gear member, and the second latching member and the first latching member are driven to be latched together by the second latching member drive mechanism. When the first latching member and the second latching member are latched together, rotation of the input gear member stops, and rotation of the frame stops.

A rotary developing device according to a third aspect of the present invention is the rotary developing device according to the second aspect, wherein the first latching member is a cam having a latching portion, and the second latching member drive mechanism is a solenoid.

A rotary developing device according to fourth aspect of the present invention is the rotary developing device according to the second aspect, further including a ring shaped plate inside the inner periphery of the ring shaped gear that supports the ring shaped gear from the inner periphery side.

Here, when the frame is driven the ring shaped gear does not easily bend as a result of vibrations or the like, so it is possible to prevent reduction of image quality caused by deviations in the position of the developing units during developing as a result of bending of the ring shaped gear.

A rotary developing device according to a fifth aspect of the present invention is the rotary developing device according to the second aspect, wherein the ring shaped gear has a second ring shaped plate that protects the gear teeth of the ring shaped gear positioned to the outside in the direction of the rotation shaft of the ring shaped gear.

Here, it is possible to prevent damage to the ring shaped gear, so it is possible to prevent deviation in the position of the developing units during developing caused by poor meshing of the gears as a result of damage to the ring shaped gear.

A rotary developing device according to a sixth aspect of the present invention is the rotary developing device according to the second aspect, wherein the first latching member has a first latching portion and a second latching portion that can latch with the second latching member.

A rotary developing device according to a seventh aspect of the present invention is the rotary developing device according to the sixth aspect, wherein a predetermined container is positioned in the developing position when the first latching portion is latched with the second latching member.

A rotary developing device according to an eighth aspect of the present invention is the rotary developing device according to the third aspect, wherein the solenoid has a main body and a projecting portion capable of being projected from the main body. When the solenoid is activated the projecting portion moves into the main body.

With the aforementioned structures, the present invention is capable of accurately positioning developing units containing developer of each respective color at the developing position, with a simple structure.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
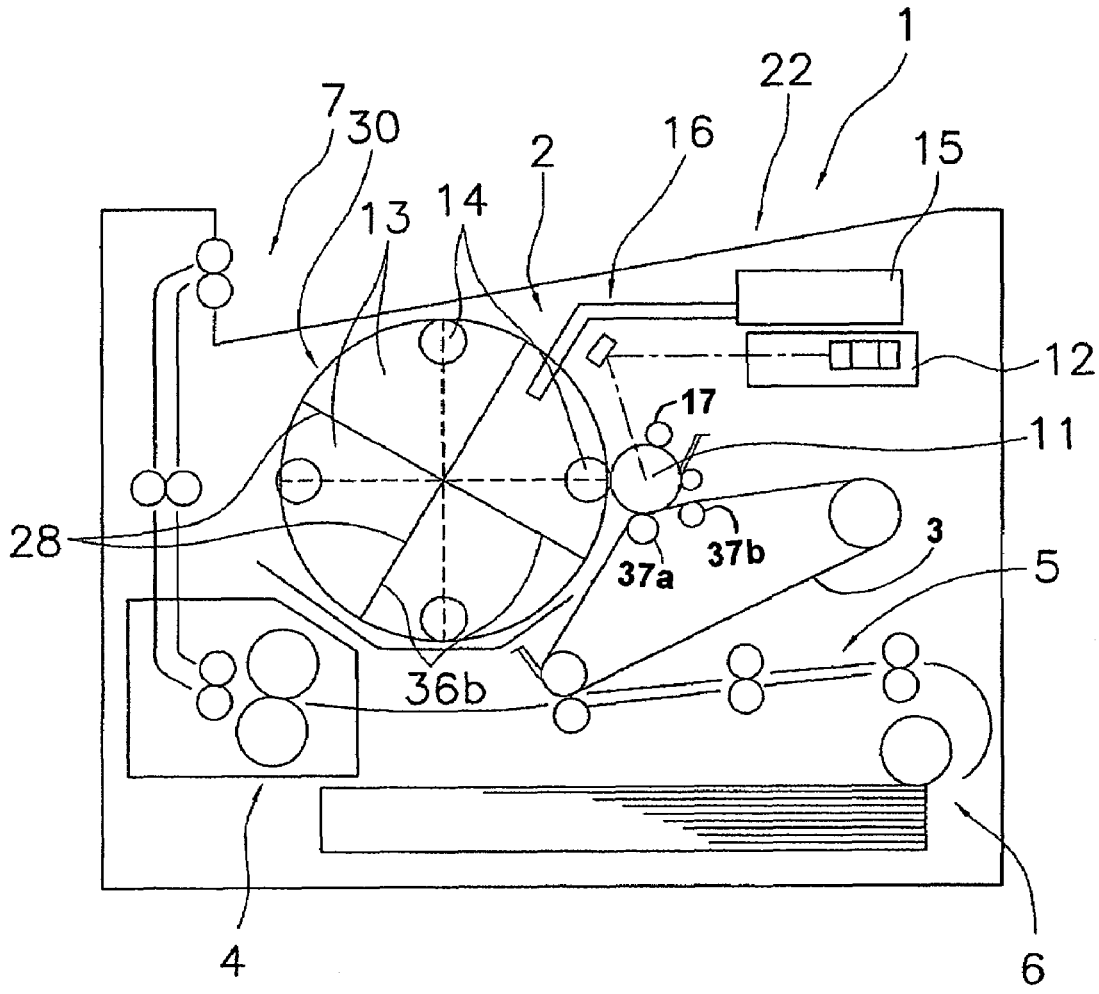
FIG. 1 is an overall schematic cross-sectional view of a color printer according to a first preferred embodiment of the present invention.

FIG. 1 shows a schematic cross-sectional view of a color printer 1 that is an image forming device according to a first preferred embodiment of the present invention. The color printer 1 can be connected to computers or the like, which are not shown in the drawings, and is a device capable of printing color images onto sheets based on image data sent from the computers or the like. The color printer 1 includes an image forming unit 2, an intermediate transfer belt 3, a fixing unit 4, a sheet transport unit 5, a sheet supply unit 6, a discharge unit 7, and a toner supply unit 22. The image forming unit 2 forms toner images based on image data. The intermediate transfer belt 3 transfers images formed in the image forming unit 2 onto sheets. The fixing unit 4 fixes the toner images formed in the image forming unit 2 on the sheets. The sheet transport unit 5 transports sheets to the image forming unit 2 and elsewhere. The sheet supply unit 6 supplies sheets to the sheet transport unit 5. The discharge unit 7 discharges sheets whose toner image has been fixed. The toner supply unit 22 supplies toner to the image forming unit 2.

The image forming unit 2 includes a photosensitive drum 11, a rotary developing device 30, a laser unit 12, and a drive unit 45. Electrostatic latent images and toner images are formed on the surface of the photosensitive drum 11. The rotary developing device 30 forms toner images on the photosensitive drum 11. The laser unit 12 scans and illuminates the surface of the photosensitive drum 11 based on the image data. The drive unit 45 drives the rotary developing device 30.

The photosensitive drum 11 is configured to contact the rotary developing device 30. Further, the rotation axis of the photosensitive drum 11 extends normal to the plane of the paper of FIG. 1. A charging roller 17 is provided above the photosensitive drum 11 to charge uniformly the surface of the photosensitive drum 11.

Figure 2:
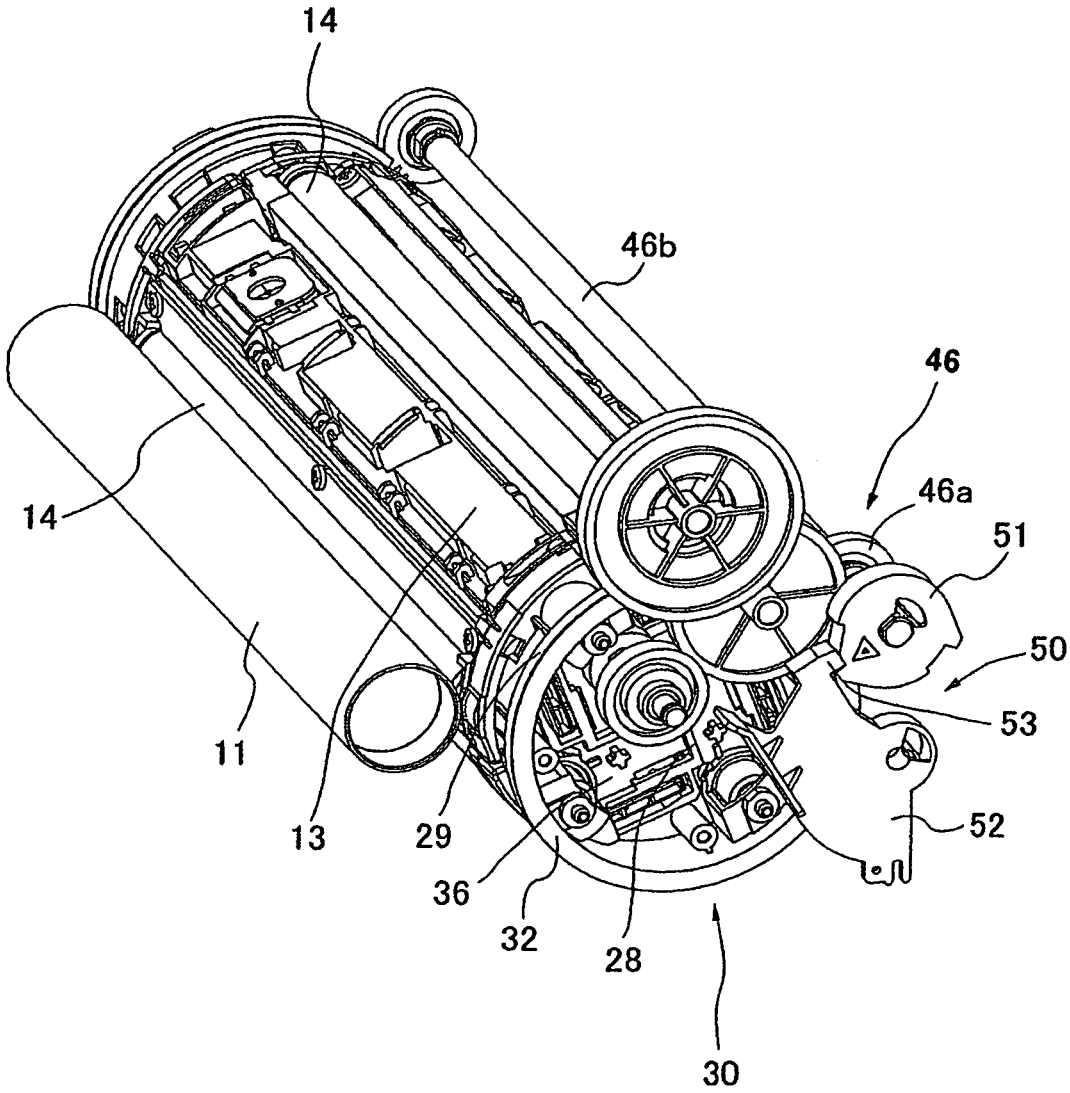
FIG. 2 is an overall isometric view of a rotary developing device of the color printer.
Figure 3:
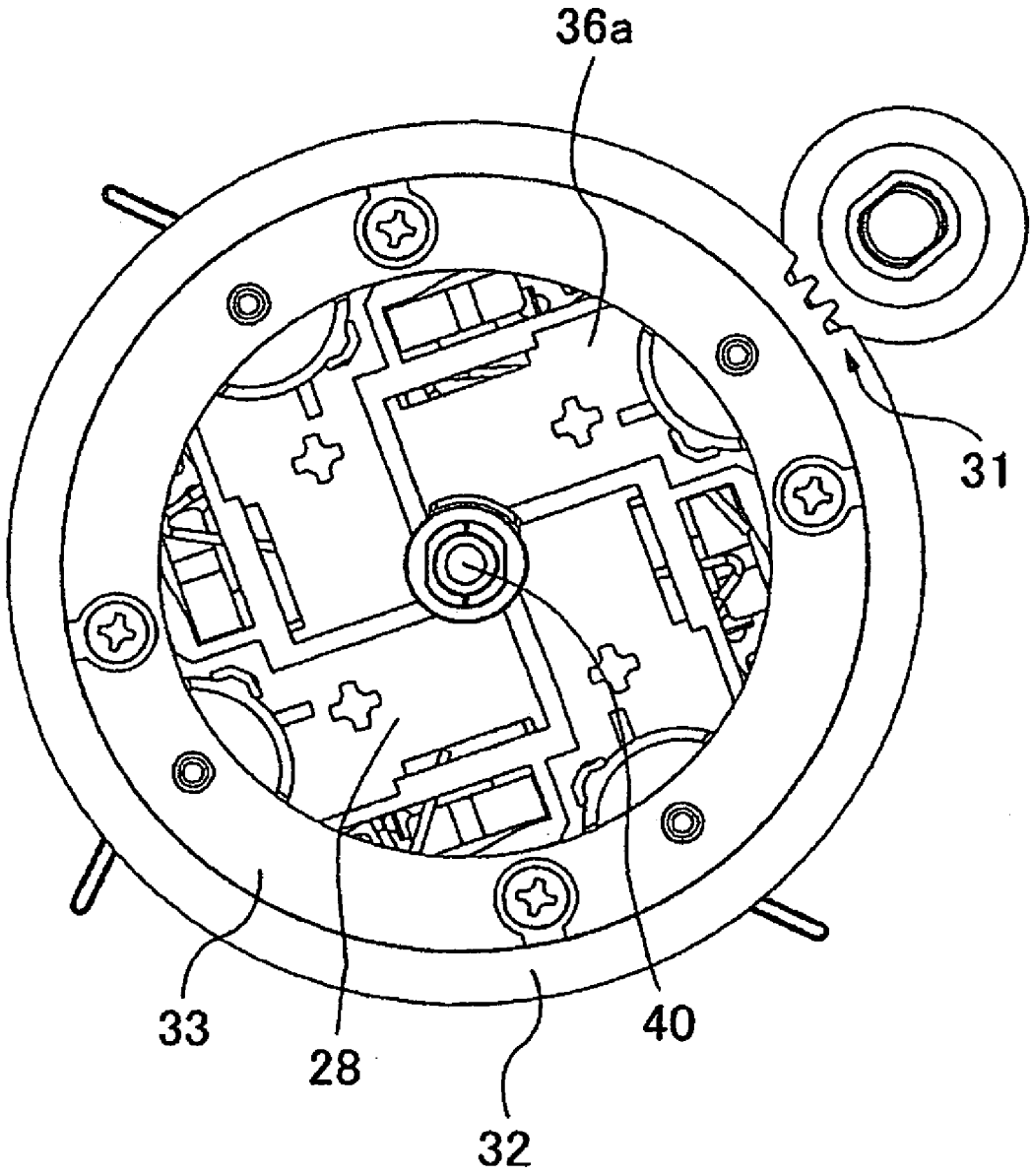
FIG. 3 is a diagrammatical elevational view showing a frame, a third ring shaped member, and an input gear of the rotary developing device.

Referring to FIGS. 1, 2, and 3, the rotary developing device 30 preferably includes four developing units 13 that each house toner in one of the four colors yellow, cyan, magenta, and black; a frame 28 that supports the four developing units 13; a third ring shaped member 33 that supports the internal and peripheral parts of the frame 28; and a rotation stop mechanism 50 that stops the rotation of the rotary developing device 30. The rotary developing device 30 rotates about a rotation shaft 40 as the center of rotation.

As shown in FIGS. 1 and 2, the four developing units 13 (containers) supply toner to the photosensitive drum 11, and are shaped like a circular cylinder cut into four equal parts in the circumferential direction. Also, each developing unit 13 contains a developing roller 14. The developing rollers 14 supply toner to the photosensitive drum 11. The four developing units 13 are supported by the frame 28.

Figure 4:
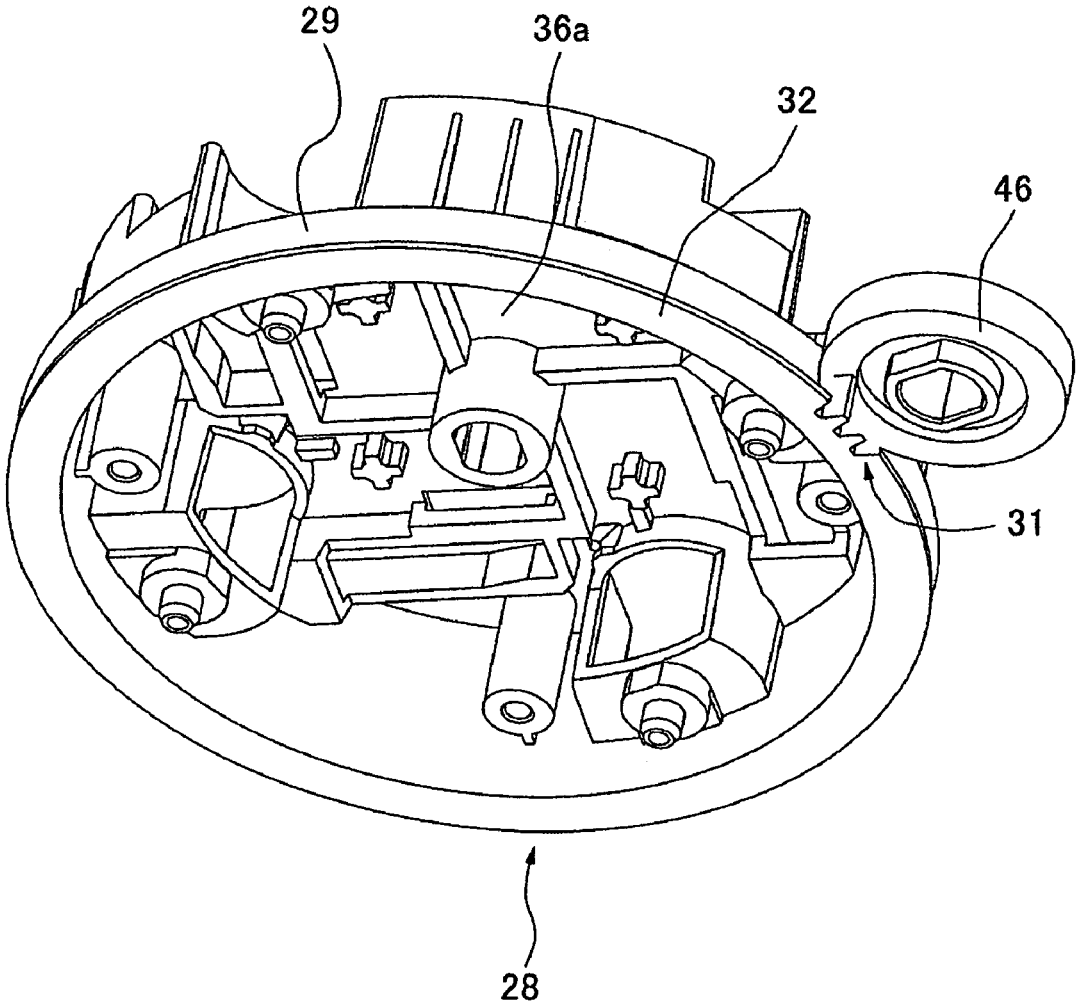
FIG. 4 is a perspective diagrammatical view showing the frame and the input gear of the rotary developing device.
Figure 7:
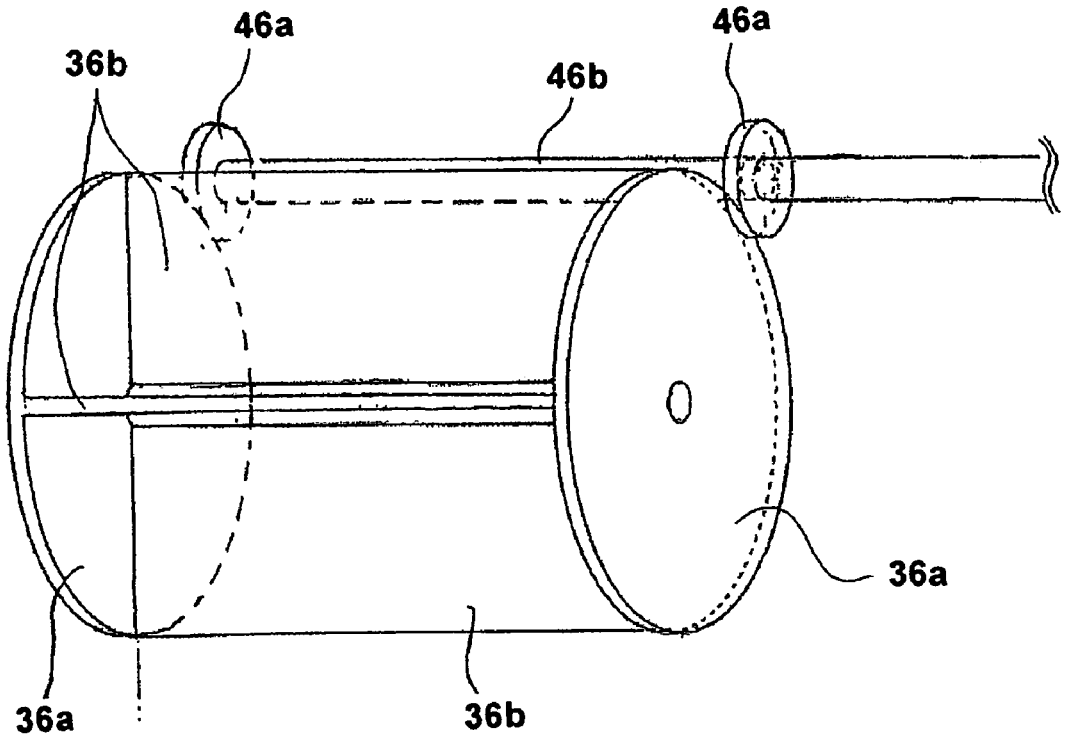
FIG. 7 is perspective view of a part of the support portion and the input gear and shaft of the color printer of FIG. 1.

Referring to FIGS. 1, 2, and 3, the frame 28 (support member) is a member that supports the four developing units 13. The frame 28 includes a support portion 36, a ring shaped gear 29, and a ring shaped rib 32. The support portion 36 supports the four developing units 13. The ring shaped gear 29 is provided at both ends of the support portion 36 in the rotation shaft 40 direction. The ring shaped rib 32 is provided on the ring shaped gear 29. As seen in FIGS. 3, 4, and 7, the support portion 36 includes four flat plate portions **36*b*, and a pair of circular plates 36*a* provided at both ends of the four flat plate portions 36*b* in the rotation shaft direction. As shown in FIG. 1, the four flat plate portions 36*b* extend in a radiating shape from the rotation shaft 40 as center, and form four compartments that divide the circumferential direction in four equal parts. As shown in FIG. 4, the ring shaped gears 29 are ring shaped parts formed to the outside of the circular plates 36*a* in the rotation shaft 40 direction. Gear teeth are formed on the external periphery of the ring shaped gears 29 that mesh with an input gear 46 of the drive unit 45 that is described later. It should apparent from this disclosure that the gear teeth are preferably configured equally spaced around the entire periphery of the ring shaped gears 29 as well as the input gear 46. Further, in this embodiment, the ring shaped gear 29 has four times the number of gear teeth as the input gear 46 that is described later. This embodiment is a color printer 1 that forms color images using toner with four colors, so the number of gear teeth is four times that of the input gear 46. Thus, for example, if the input gear 46 had 24 teeth, then the ring shaped gear 29 would have 96 teeth. Alternatively, if the input gear 46 had 27 teeth, then the ring shaped gear 29 would have 108 teeth. However, if the embodiment used three colors of toner, the number of gear teeth would be three times that of the input gear 46. As shown in FIG. 4, the ring shaped ribs 32 are provided at the ends of the ring shaped gears 29 in the rotation shaft 40 direction. The ring shaped ribs 32 are ring shaped members extending further in the peripheral direction than the gear teeth of the ring shaped gears 29. Furthermore, the ring shaped ribs 32 include a cut out portion 31 in which a part is cut out leaving a part that overlaps with gear teeth of the ring shaped gear 29. The cut out portion 31 is a cut out extending across an area in the circumferential direction that includes three gear teeth of the ring shaped gear 29**.

As shown in FIGS. 2 and 3, the third ring shaped member 33 (ring shaped plate) is a ring shaped plate member that supports the ring shaped gear 29 of the support portion 36 of the frame 28 from the inner periphery. The third ring shaped member 33 is fixed by screws to the circular plates 36*a* of the support portion 36 so that the third ring shaped member 33 is concentric with the ring shaped gear 29. The outer periphery of the third ring shaped member 33 contacts the inner periphery of the ring shaped gear 29.

As seen in FIG. 1, the laser unit 12 illuminates the photosensitive drum 11 with laser light.

Figure 5:
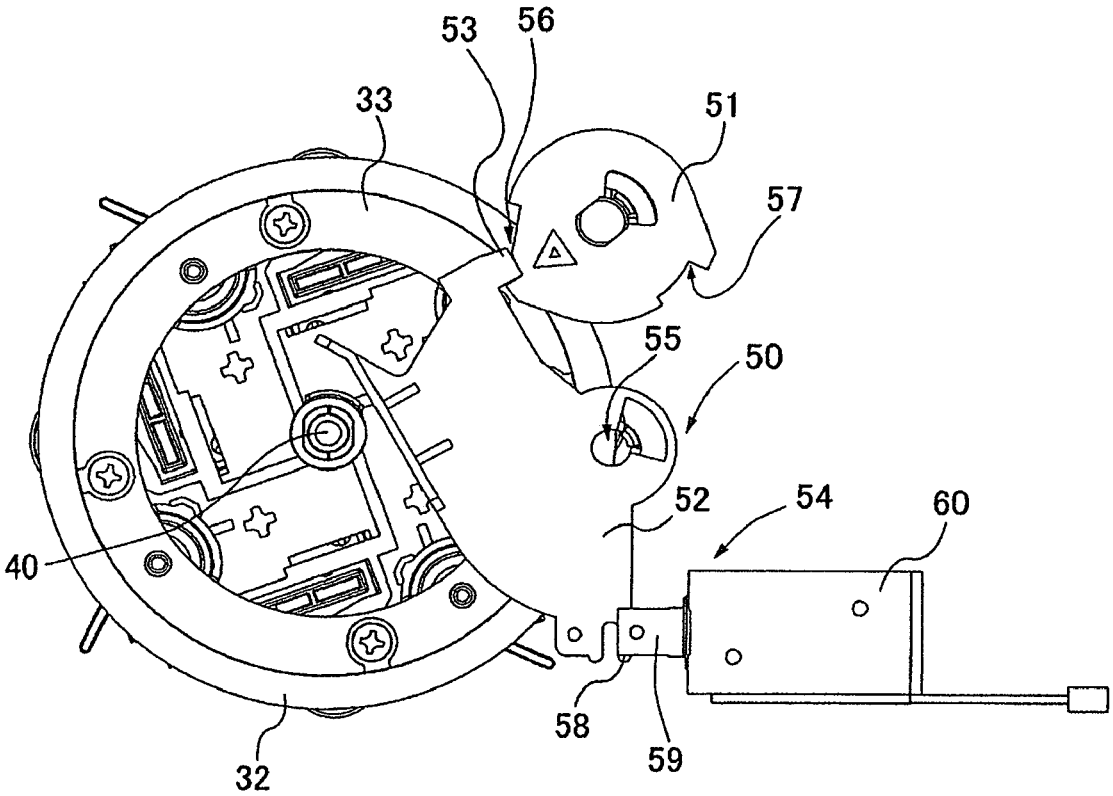
FIG. 5 is a diagrammatical elevational view showing a rotation stop mechanism of the rotary developing device.

As shown in FIGS. 2 and 5, the rotation stop mechanism 50 includes an input cam 51 (first latching member), a latching member 52 (second latching member), and a solenoid 54. The input cam 51 (first latching member) is preferably connected concentrically with the input gear 46. The latching member 52 (second latching member) has a projecting portion 53 that latches with the input cam 51. Further, the solenoid 54 drives the latching member 52. The input cam 51 is a member installed on a shaft member 46*b* of the input gear 46 that is described later, and that is disposed to the outside in the shaft member 46*b* direction of a circular plate shaped member 46*a* that is described later (see FIG. 2). Also, as seen in FIG. 5, the input cam 51 is a circular plate shaped member, having a first latching portion 56 and a second latching portion 57 that latch with the projecting portion 53 of the latching member 52. When the first latching portion 56 is latched with the projecting portion 53, one of the developing units 13 for each color is in opposition to the photosensitive drum 11, in other words one of the developing units 13 is positioned in the developing position. Also, when the first latching portion 56 is latched with the projecting portion 53, it is possible to supply toner. When the second latching portion 57 is latched with the projecting portion 53, the device is in the standby position, the developing rollers 14 are separated from the photosensitive drum 11, so that maintenance can be carried out. The latching member 52 is a flat plate shaped member that includes a support portion 55 that is supported by the external frame of the color printer 1, and a connection portion 58 that is connected to the projecting portion 53 that latches with the first latching portion 56 of the input cam 51 and the solenoid 54. Also, the projecting portion 53 is forced against the input cam 51 by an elastic member not shown in the drawings. The solenoid 54 includes a main body 60 and a projecting portion 59 that projects from the main body 60. The solenoid 54 is preferably fixed to the external frame of the color printer 1. Every time that developing is completed by each developing unit 13, the solenoid 54 is activated and the projecting portion 59 is moved into the main body 60. By moving the projecting portion 59 into the main body 60, the latch between the latching member 52 and the input cam 51 is released. After a predetermined period of time has passed since the completion of developing (during which the first latching portion 56 and the second latching portion 57 are not latched) the solenoid 54 is deactivated.

Figure 6:
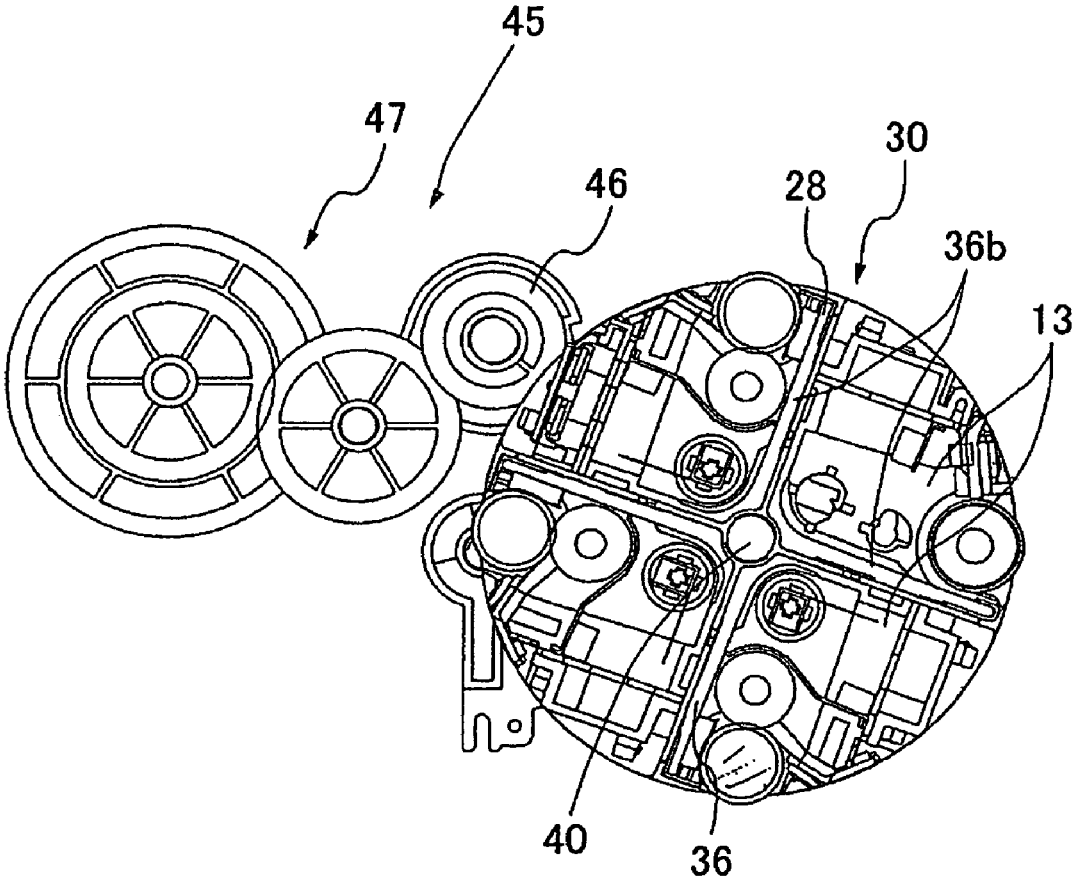
FIG. 6 is a diagrammatical elevational view showing a drive unit and the rotary developing device.

As shown in FIGS. 2 and 6, the drive unit 45 is a unit that rotates the rotary developing device 30. The drive unit 45 includes the input gear 46, a gear train 47 that rotates the input gear 46, and a motor (not shown in the drawings) to which the gear train 47 is connected. The input gear 46 includes a pair of circular plate shaped members 46*a* whose outer diameter is smaller than the ring shaped gear 29 and a shaft member 46*b* that connects the pair of circular plate shaped members 46*a*. Gear teeth that mesh with the gear teeth on the outer periphery of the ring shaped gear 29 are formed on the pair of circular plate shaped members 46*a*. The shaft member 46*b* is a cylindrical shaped member that is provided parallel with the rotation shaft 40 of the rotary developing device 30. The gear train 47 is a part that transmits power from the motor to the input gear 46, and includes a plurality of gears. The motor is the part that generates the power to rotate the rotary developing device 30, and is connected to the gear train 47.

As seen in FIG. 1, the intermediate transfer belt 3 is the part to which the toner image in each color formed on the photosensitive drum 11 is transferred in turn. The intermediate transfer belt 3 spans between a drive roller and a driven roller that is forced in the direction away from the drive roller by a spring. Also, the part of the intermediate transfer roller 3 in opposition to the photosensitive drum 11 is made to contact the photosensitive drum 11 by a pair of primary transfer rollers 37*a* and 37*b*.

The fixing unit 4 is the part that fixed the images formed in the image forming unit 2 to sheets. The fixing unit 4 includes a pressure roller and a heating roller.

The sheet transport unit 5 is the part that transports sheets to the image forming unit 2 and the fixing unit 4. The sheet transport unit 5 includes a transport path extending from the sheet supply unit 6 to the discharge unit 7.

The sheet supply unit 6 includes a sheet supply cassette that houses sheets to print, a roller that supplies sheets to the sheet transport unit 5, and so on. Also, the sheet supply unit 6 is disposed towards the bottom of the color printer 1.

The discharge unit 7 is the part from which sheets onto which images have been fixed are discharged via the sheet transport unit 5. The discharge unit 7 is disposed in the top surface of the color printer 1.

The toner supply unit 22 is the part that supplies toner to the developing units 13. The toner supply unit 22 includes a toner housing unit 15 that houses toner to be supplied, and a toner supply device 16 that supplies toner from the toner housing unit 15 to the developing units 13. The toner housing unit 15 preferably includes four box shaped containers that house the toner for each color. The toner supply device 16 is the part that supplies toner to the developing units 13, and includes a toner supply pipe. When supplying toner, the toner supply pipe is moved, and toner is supplied into the developing units 13.

Operation

In the color printer 1, image data are transmitted from an external connected computer, and a toner image is formed in the image forming unit 2 based on the image data. Specifically, an electrostatic latent image is formed on the photosensitive drum 11 based on the image data. The rotary developing device 30 is rotated and moved to a position in which the toner image for the first color can be formed. In detail, as shown in FIGS. 2 and 5, the projecting portion 53 of the latching member 52 is forced towards the input cam 51, the input cam 51 rotates and when the first latching portion 56 latches with the projecting portion 53 rotation of the input gear 46 stops. When rotation of the input gear 46 has stopped as a result of the first latching portion 56 latching with the projecting portion 53, the attitude of the frame 28 is such that one of the developing rollers 14 of the developing units 13 is in opposition to the photosensitive drum 11, in other words in the developing position. The toner image of the first color is formed on the photosensitive drum 11. Then the rotary developing device 30 rotates through about 90 degrees and sets up the position in which the toner image for the second color can be formed. In detail, when developing is complete, the solenoid 54 is activated, the projecting portion 59 moves within the solenoid main body 60. Further, as the projecting portion 59 moves within the main body 60 the latching member 52 moves the projecting portion 53 in the opposite direction to the input cam 51. In this way, the latch between the projecting portion 53 and the first latching portion 56 is released, the input cam 51 rotates, and at the location where the home position is being passed, activation of the solenoid 54 is cut off, and the projecting portion 53 moves towards the input cam 51. Then, with the projecting portion 53 forced against the input cam 51, the input cam 51 rotates, the first latching portion 56 latches with the projecting portion 53, and the developing unit 13 is positioned at the developing position. When the input gear 46 is rotated from the developing position of the first color, the input gear 46 rotates to the position of the developing position of the second color. In this way, a color toner image is formed by forming toner images of each of the four colors in turn. At this time, as seen in FIG. 1, a sheet onto which the toner image is transferred is transported to the image forming unit 2 by the sheet transport unit 5, and the color image is transferred onto this sheet. Then, the sheet onto which the color image was transferred is transported to the fixing unit 4, the color image is fixed to the sheet, and the sheet is discharged from the discharge unit 7. In this way, a sheet onto which a color image is fixed based on image data transmitted from a computer or the like is discharged.

When the rotary developing device 30 rotates vibrations are generated by the rotation. However, the internal periphery of the ring shaped gear 29 of the frame 28 is supported by the third ring shaped member 33, so bending of the ring shaped gear 29 is prevented.

When assembling the color printer 1 or carrying out maintenance, the input gear 46 and the like that drive the rotary developing device 30 is installed in advance within the outer frame of the color printer 1. The rotary developing device 30 is placed on a platform or the like and aligned so that the rotary developing device 30 can mesh with the input gear 46. Then the rotary developing device 30 is inserted from the near side of the plane of the paper of FIG. 1 into the plane of the paper of FIG. 1 so that the gear teeth of the input gear 46 mesh with the gear teeth of the ring shaped gear 29.

Here, the number of gear teeth of the ring shaped gear 29 is four times the number or gear teeth of the input gear 46. Therefore, each revolution of the input gear 46 from the developing position of the first color is also a developing position. Therefore, by controlling the rotation of the input gear 46 the developing units 13 can be easily positioned in the developing position. Therefore, it is possible to accurately align the developing units 13 in the developing position using a simple configuration.

Other Embodiments

The embodiment described above was a color printer 1 that forms color images using toner with four colors. However, the present invention is not limited to this, and three colors or six colors and so on may be used. In this case, the number of gear teeth in the ring shaped gear 29 of the rotary developing device 30 is three times or six times the number of gear teeth in the input gear 46. Also, in the above embodiment rotation of the input gear 46 is stopped by the input cam 51. However the present invention is not limited to this, and the amount of rotation of the input gear 46 may be controlled by a control unit (computer) or similar. In this case, the input gear 46 is easily controlled so that the position is in the developing position every revolution of the input gear 46.

Terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of a image forming device equipped with the present invention. Accordingly, these terms, as utilized to describe the present invention should be interpreted relative to an image forming device equipped with the present invention as used in the normal riding position. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rotary developing device provided in an image forming device that is rotated by an input gear member to which motive force is input from a drive source, comprising:

a plurality of containers being configured to house individually a color developer configured to develop at a plurality of respective developing positions;

a support portion having a rotation shaft being configured to support said plurality of containers;

a support member having a ring shaped gear being configured to be rotated by the input gear member, a number of gear teeth in said ring shaped gear being a number of gear teeth in the input gear multiplied by the number of said plurality of containers; and a rotation stop mechanism having a first latching member being fitted to said input gear member, a second latching member being configured to latch with said first latching member, and a second latching member drive mechanism being connected to said second latching member that drives said second latching member to latch and to unlatch said second latching member and said first latching member.

2. The rotary developing device according to claim 1, wherein said first latching member is a cam having a latching portion, and said second latching member drive mechanism is a solenoid.

3. The rotary developing device according to claim 1, further comprising a ring shaped plate arranged inside an inner periphery of the ring shaped gear that supports said ring shaped gear from an inner periphery side.

4. The rotary developing device according to claim 1, wherein said ring shaped gear has a ring shaped rib to the outside in the direction of a rotation shaft extending as far as the outer periphery of said gear teeth of said ring shaped gear.

5. The rotary developing device according to claim 1, wherein said first latching member has a first latching portion and a second latching portion that configured to latch with said second latching member.

6. The rotary developing device according to claim 5, wherein when said first latching portion is latched with said second latching member, one of said plurality of containers is positioned in its respective developing position.

7. The rotary developing device according to claim 2, wherein said solenoid has a main body and a projecting portion configured to be projected from said main body, and when said solenoid is activated the projecting portion moves into said main body.

8. An image forming apparatus comprising:

an image support member having a surface, an electrostatic latent image being configured to be formed thereon;

a gear train;

an input gear member having a plurality of teeth being configured to be rotated by said gear train; and rotary type developing device being configured to receive a force from said input gear and being arranged to supply toner to said image support member, said rotary type developing device having a plurality of containers being configured to house individually a color developer configured to develop at a plurality of respective developing positions, a support portion having a rotation shaft being configured to support said plurality of containers, a support member having a ring shaped gear being configured to be rotated by the input gear member, and a rotation stop mechanism being configured to stop the rotation of said support member at each of said plurality of developing positions, said rotation stop mechanism having a first latching member being fitted to said input gear member, a second latching member being configured to latch with said first latching member, and a second latching member drive mechanism being connected to said second latching member that drives said second latching member to latch and to unlatch said second latching member and said first latching member.

9. The image forming apparatus according to claim 8, wherein said first latching member is a cam having a latching portion, and said second latching member drive mechanism is a solenoid.

10. The image forming apparatus according to claim 8, further comprising a ring shaped plate arranged inside an inner periphery of the ring shaped gear that supports said ring shaped gear from an inner periphery side.

11. The image forming apparatus according to claim 8, wherein a number of gear teeth in said ring shaped gear is a number of gear teeth in the input gear multiplied by the number of said plurality of containers.

12. The image forming apparatus according to claim 8, wherein said first latching member has a first latching portion and a second latching portion that configured to latch with said second latching member.

13. The image forming apparatus according to claim 12, wherein when said first latching portion is latched with said second latching member, one of said plurality of containers is positioned in its respective developing position.

14. The image forming apparatus according to claim 9, wherein said solenoid has a main body and a projecting portion configured to be projected from said main body, and when said solenoid is activated the projecting portion moves into said main body.

15. The image forming apparatus according to claim 11, wherein said ring shaped gear has a ring shaped rib to the outside in the direction of a rotation shaft extending as far as the outer periphery of said gear teeth of said ring shaped gear.

16. An image forming apparatus comprising:

an image support member having a surface, an electrostatic latent image being configured to be formed thereon;

a gear train;

an input gear member having a plurality of teeth being configured to be rotated by said gear train;

rotary type developing device being configured to receive a force from said input gear and being arranged to supply toner to said image support member, said rotary type developing device having a plurality of containers being configured to house individually a color developer configured to develop at a plurality of respective developing positions, a support portion having a rotation shaft being configured to support said plurality of containers, a support member having a ring shaped gear being configured to be rotated by the input gear member, a number of gear teeth in said ring shaped gear being a number of gear teeth in the input gear multiplied by the number of said plurality of containers, and a rotation stop mechanism being configured to stop selectively said support member at one of said plurality of respective developing positions and a standby position, said rotation stop mechanism having a first latching member being fitted to said input gear member, a second latching member being configured to latch with said first latching member, and a second latching member drive mechanism being connected to said second latching member that drives said second latching member to latch and to unlatch said second latching member and said first latching member.

17. The image forming apparatus according to claim 16, wherein said first latching member is a cam having a latching portion, and said second latching member drive mechanism is a solenoid.

18. The image forming apparatus according to claim 16, further comprising a ring shaped plate arranged inside an inner periphery of the ring shaped gear that supports said ring shaped gear from an inner periphery side.

19. The image forming apparatus according to claim 16, wherein said ring shaped gear has a ring shaped rib to the outside in the direction of a rotation shaft extending as far as the outer periphery of said gear teeth of said ring shaped gear.

20. The image forming apparatus according to claim 16, wherein said first latching member has a first latching portion and a second latching portion that configured to latch with said second latching member.

21. The image forming apparatus according to claim 20, wherein when said first latching portion is latched with said second latching member, one of said plurality of containers is positioned in its respective developing position.

22. The image forming apparatus according to claim 17, wherein said solenoid has a main body and a projecting portion configured to be projected from said main body, and when said solenoid is activated the projecting portion moves into said main body.

* * * * *